US006754919B2

(12) United States Patent
Leaphart, Jr. et al.

(10) Patent No.: US 6,754,919 B2
(45) Date of Patent: Jun. 29, 2004

(54) PROTECTIVE COVER ARTICLE

(75) Inventors: Edward Wright Leaphart, Jr., Appleton, WI (US); Sarah Lee Christoffel, Appleton, WI (US); Laurie Couture-Dorschner, Hortonville, WI (US); Catherine Marguerite Hancock-Cooke, Neenah, WI (US); Christopher Dines Nelsen, Neenah, WI (US); Brendon Frank Ribble, Menasha, WI (US); Marci Elizabeth Sojka, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/865,179

(22) Filed: May 24, 2001

(65) Prior Publication Data

US 2002/0004114 A1 Jan. 10, 2002

Related U.S. Application Data

(60) Provisional application No. 60/208,556, filed on Jun. 1, 2000.

(51) Int. Cl.[7] ..... A47B 97/00
(52) U.S. Cl. ..... 5/417; 5/420
(58) Field of Search ..... 5/417, 420; 108/90

(56) References Cited

U.S. PATENT DOCUMENTS

| | | | | |
|---|---|---|---|---|
| 3,226,737 A | | 1/1966 | Rote | |
| 3,338,992 A | | 8/1967 | Kinney | |
| 3,341,394 A | | 9/1967 | Kinney | |
| 3,502,763 A | | 3/1970 | Hartmann | |
| 3,542,615 A | | 11/1970 | Dobo et al. | |
| 3,692,618 A | | 9/1972 | Dorschner et al. | |
| 3,772,131 A | | 11/1973 | Triplett | |
| 3,772,137 A | | 11/1973 | Tolliver | |
| 3,802,817 A | | 4/1974 | Matsuki et al. | |
| 3,849,241 A | | 11/1974 | Butin et al. | |
| 3,855,046 A | | 12/1974 | Hansen et al. | |
| 3,862,876 A | | 1/1975 | Graves | |
| 3,960,193 A | * | 6/1976 | Davis | 108/90 |
| 4,003,509 A | | 1/1977 | Camarero | |
| 4,041,203 A | | 8/1977 | Brock et al. | |
| 4,223,056 A | | 9/1980 | Di Fronzo | |
| 4,340,563 A | | 7/1982 | Appel et al. | |
| 4,374,888 A | | 2/1983 | Bornslaeger | |
| 4,493,866 A | | 1/1985 | Kim | |
| 4,499,133 A | | 2/1985 | Prince | |
| 4,506,398 A | | 3/1985 | Hruban | |
| 4,546,516 A | | 10/1985 | Kim | |
| 4,580,372 A | | 4/1986 | Osborn | |

(List continued on next page.)

FOREIGN PATENT DOCUMENTS

| | | |
|---|---|---|
| EP | 0 933 072 A2 | 8/1999 |
| WO | WO 01/45506 A1 | 6/2001 |

OTHER PUBLICATIONS

AATCC Test Method 16–1998, "Colorfastness to Light," Technical Manual of the American Association of Textile Chemists and Colorists, 2001, pp. 23–34.

AATCC Test Method 61–1996, "Colorfastness to Laundering, Home and Commercial: Accelerated," Technical Manual of the American Association of Textile Chemists and Colorist, 2001, pp. 88–92.

(List continued on next page.)

*Primary Examiner*—Heather Shackelford
*Assistant Examiner*—Fredrick Conley
(74) *Attorney, Agent, or Firm*—Patricia A. Charlier; John L. Brodersen

(57) ABSTRACT

A nonwoven fabric protective cover article disclosed comprises a top surface, a bottom surface, at least one edge, and at least one weight joined thereto. The nonwoven fabric of the protective cover article is hydrophobic and has a basis weight from between about 0.15 osy to about 8.0 osy, an air permeability from about 60 $ft^3/min/ft^2$ to about 110 $ft^3/min/ft^2$, and stain resistance from about 4 to about 5 for blueberry, instant coffee, gravy, and wine.

49 Claims, 3 Drawing Sheets

U.S. PATENT DOCUMENTS

| | | | | |
|---|---|---|---|---|
| 4,599,754 | A | | 7/1986 | Mairs, III et al. |
| 4,606,968 | A | | 8/1986 | Thornton et al. |
| 4,631,933 | A | | 12/1986 | Carey, Jr. |
| 4,634,618 | A | | 1/1987 | Greer et al. |
| 4,654,906 | A | | 4/1987 | Roberts |
| D291,133 | S | | 7/1987 | Disanza |
| 4,690,585 | A | | 9/1987 | Holmberg |
| 4,692,618 | A | | 9/1987 | Klatt |
| 4,709,430 | A | | 12/1987 | Nicoll |
| 4,736,478 | A | | 4/1988 | Dangerously |
| D299,979 | S | | 2/1989 | Garrison |
| 4,885,195 | A | | 12/1989 | Change, III |
| 4,889,446 | A | | 12/1989 | Holmberg |
| 4,891,957 | A | | 1/1990 | Strack et al. |
| 4,904,514 | A | | 2/1990 | Morrison et al. |
| 4,910,855 | A | | 3/1990 | Balarzs |
| 4,938,607 | A | | 7/1990 | Kelley |
| 4,955,068 | A | | 9/1990 | Tennihan |
| 4,961,981 | A | | 10/1990 | Keegan |
| 4,966,406 | A | | 10/1990 | Karasik et al. |
| 5,018,229 | A | | 5/1991 | Eberhart |
| 5,018,230 | A | | 5/1991 | Steberger |
| 5,059,463 | A | | 10/1991 | Peters |
| 5,066,143 | A | | 11/1991 | Sanders |
| 5,069,554 | A | | 12/1991 | Bonnett |
| 5,072,467 | A | | 12/1991 | Hunt |
| 5,082,707 | A | | 1/1992 | Fazio |
| 5,108,820 | A | | 4/1992 | Kaneko et al. |
| 5,108,827 | A | | 4/1992 | Gessner |
| D327,345 | S | | 6/1992 | Lammon et al. |
| 5,134,017 | A | | 7/1992 | Baldwin et al. |
| 5,141,200 | A | | 8/1992 | Sherman et al. |
| 5,145,727 | A | | 9/1992 | Potts et al. |
| 5,149,576 | A | | 9/1992 | Potts et al. |
| 5,158,395 | A | | 10/1992 | Holmberg |
| 5,169,706 | A | | 12/1992 | Collier, IV et al. |
| 5,178,931 | A | | 1/1993 | Perkins et al. |
| 5,188,885 | A | | 2/1993 | Timmons et al. |
| D349,593 | S | | 8/1994 | Hensley |
| 5,336,552 | A | | 8/1994 | Strack et al. |
| 5,339,748 | A | | 8/1994 | Bilotti |
| 5,364,156 | A | | 11/1994 | Zerow |
| 5,364,188 | A | | 11/1994 | Godfried et al. |
| 5,382,400 | A | | 1/1995 | Pike et al. |
| 5,417,462 | A | | 5/1995 | Hensley |
| 5,484,645 | A | * | 1/1996 | Lickfield et al. ..... 128/849 |
| 5,499,411 | A | | 3/1996 | Wong |
| 5,534,339 | A | | 7/1996 | Stokes |
| D379,081 | S | | 5/1997 | Wilson |
| 5,664,825 | A | | 9/1997 | Henke et al. |
| D386,865 | S | | 11/1997 | Storm |
| D389,451 | S | | 1/1998 | Wilson |
| 5,706,950 | A | | 1/1998 | Houghton et al. |
| 5,736,469 | A | | 4/1998 | Bhattacharjee et al. |
| 5,740,567 | A | | 4/1998 | Mitchell |
| D408,233 | S | | 4/1999 | Price |
| 5,966,757 | A | | 10/1999 | Sullivan |
| 5,989,004 | A | | 11/1999 | Cook |
| D422,855 | S | | 4/2000 | Del Rosso |
| 6,202,718 | B1 | | 3/2001 | Innocenti |
| 6,384,101 | B1 | * | 5/2002 | Park et al. ..... 522/71 |

OTHER PUBLICATIONS

American Society for Testing Materials (ASTM) Designation: D 1175–80, Standard Test Methods for Abrasion Resistance of Textile Fabrics (Oscillatory Cylinder and Uniform Abrasion Methods), pp. 1–14, published May 1980.

AATCC Test Method 135–1995, "Dimensional Changes in Automatic Home Laundering of Woven and Knit Fabrics," Technical Manual of the American Association of Textile Chemists and Colorists, 1999, pp. 230–232.

American Society for Testing Materials (ASTM) Designation: D 1682–64, "Standard Test Methods for Breaking Load and Elongation of Textile Fabrics,"pp. 454–459, published Oct. 1964.

American Society for Testing Materials (ASTM) Designation: D 1776–98, "Standard Practice for Conditioning and Testing Textiles," pp. 432–435, published Feb. 1999.

American Society for Testing Materials (ASTM) Designation: D 3512–99a, "Standard Test Method for Pilling Resistance and Other Related Surface Changes of Textile Fabrics: Random Tumble Pilling Tester," pp. 23–28, published Dec. 1999.

American Society for Testing Materials (ASTM) Designation: D 3776–96, "Standard Test Methods for Mass Per Unit Area (Weight) of Fabric," pp. 86–89, published Jun. 1996.

American Society for Testing Materials (ASTM) Designation: D 3885–99, "Standard Test Methods for Abrasion Resistance of Textile Fabrics (Flexing and Abrasion Method)," pp. 163–170, published Jun. 1999.

American Society for Testing Materials (ASTM) Designation: D 4265–98, "Standard Test Methods for Evaluating Stain Removal Performance in Home Laundering," pp. 449–454, published Jun. 1998.

American Society for Testing Materials (ASTM) Designation: D 737–96, "Standard Test Method for Air Permeability of Textile Fabrics," pp. 207–211, published Apr. 1996.

INDA Standard Test Method lST 90.0 –75. "Handle–O–Meter Stiffness," last revised 1982, 4 pages.

TAPPI Official Test Method T 402 om–93, "Standard Conditioning and Testing Atmospheres For Paper, Board, Pulp Handsheets, and Related Products," published by the TAPPI Press, Atlanta, Georgia, revised 1993, pp. 1–3.

Manson, John A. and Leslie H. Sperling, "Bicomponent and Biconstituent Fibers," *Polymer Blends and Composites*, Plenum Press, New York, Section 9.2, 1976, pp. 273–277.

* cited by examiner

PROTECTIVE COVER ARTICLE

This application claims the benefit of Provisional Application Ser. No. 60/208,556, filed Jun. 1, 2000.

BACKGROUND OF THE INVENTION

This invention pertains to a protective cover article such as a ground cover blanket, a tablecloth, a beach towel, changing pad, rug, mat, or a placemat intended for everyday use. Consumers are always looking for economical blankets or protective cover articles, which are both disposable and resilient for everyday use.

Currently, such products are typically made from durable (reusable) pieces of fabric, such as cloth or woven fabric, cut from a larger bolt of the fabric and affected into the specific products. Other such products are made from disposable paper materials. In both cases, the fabrics or paper fabrics are typically hydrophilic. While the products made from the durable fabrics can withstand exposure to water or other fluids, the products made from the paper materials typically cannot withstand such exposures. The products made from paper materials typically disintegrate with exposure to fluids or some of its qualities, such as its appearance, are affected. Where the paper materials are designed to withstand exposure to fluids, the materials typically lose the qualities of softness, flexibility, and cloth-like feel and appearance desired in blankets, towels, and other protective cover articles.

Another concern with the hydrophilic characteristics of the current durable and disposable protective cover articles is that such articles absorb or otherwise attract fluids from the surrounding environment thereby becoming wet. The protective cover articles, once wet, are typically not suitable for most uses, i.e. a ground cover blanket used at a picnic. A plastic or rubber coating is typically applied to the durable fabrics or paper materials to provide a hydrophobic quality to the products. However, some of the other qualities of the fabrics or materials are lost as discussed above. In addition, the durable fabrics or paper materials portions of the current products are still hydrophilic, so the issues of fluid absorption and dampness remain.

Most of the paper materials used in the current disposable products are not suitable for use in many protective cover articles, such as a ground cover blanket or a tablecloth in outdoor situations. The paper materials lack the resilience, weight and drapability of the durable fabrics, such that the paper materials typically do not provide products having sufficient quality for outdoor use, such as tablecloths, beach towels, and picnic blankets.

SUMMARY OF THE INVENTION

Thus, there is a need to provide an improved protective cover article, including washable and disposable protective cover articles. There is also a need to provide soft, flexible, cloth-like, and inexpensive protective cover articles. In addition, the protective cover articles need to be light weight, easy to store, and durable during use. In response to this need, an improved economical and resilient protective cover article, including ground cover blankets, tablecloths, beach towels, changing pads, rugs, mats, and placemats, and the like has been discovered.

One embodiment of the present invention is a fabric protective cover article comprising a top surface, a bottom surface and, at least one edge. The fabric of the protective cover article is hydrophobic and has a basis weight from between about 0.15 osy to about 8.0 osy, an air permeability from about 60 $ft^3/min/ft^2$ to about 110 $ft^3/min/ft^2$, and stain resistance from about 4 to about 5 for blueberry, instant coffee, gravy, and wine.

Another embodiment of the present invention is a nonwoven fabric protective cover article comprising a top surface, a bottom surface and, at least one edge. The nonwoven fabric of the protective cover article is hydrophobic and has a basis weight from between about 0.15 osy to about 8.0 osy, an air permeability from about 60 $ft^3/min/ft^2$ to about 110 $ft^3/min/ft^2$, and stain resistance from about 4 to about 5 for blueberry, instant coffee, gravy, and wine.

BRIEF DESCRIPTION OF THE DRAWINGS

The above-mentioned and other features of the present invention and the manner of attaining them will become more apparent, and the invention itself will be better understood by reference to the following description of the invention, taken in conjunction with the accompanying drawings, wherein.

DEFINITIONS

Figure 1:
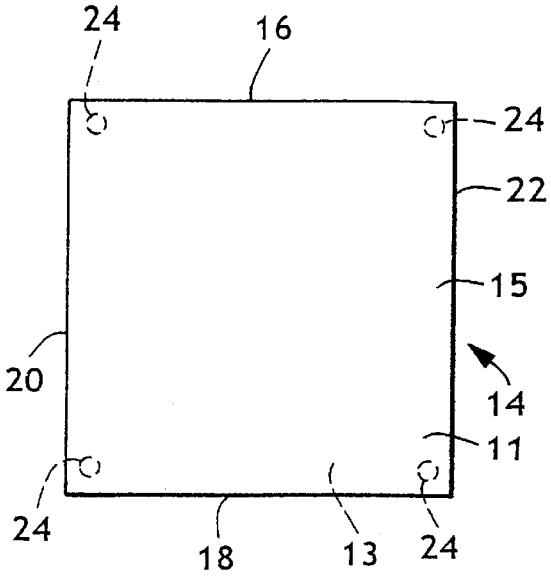
FIG. 1 is a top plan view of a protective cover article.

Within the context of this specification, each term or phrase below will include the following meaning or meanings:

(a) "Air permeable" or "Breathable" means fabrics which are capable of acting as a barrier to particulate matter, water, and other liquids yet which allow water vapor and air to pass therethrough. Such fabrics may be referred to as "breathable barriers." Articles or products made using breathable fabrics are generally more comfortable to wear or use since the migration of water vapor through the fabric helps to reduce and/or eliminate discomfort resulting from excess moisture trapped against the skin.

(b) "Bonded carded fabric or web", "bonded carded web", and "bonded carded fabric" refer to fabric or webs made from staple fibers which are sent through a combing or carding unit, which individualizes and aligns the staple fibers in the machine direction to form a generally machine direction-oriented fibrous nonwoven web. Such fibers are usually purchased in bales which are placed in a picker which separates the fibers prior to the carding unit. Once the web or fabric is formed, it is then bonded by one or more of several known bonding methods. One such bonding method is powder bonding, wherein a powdered adhesive is distributed through the web or fabric and then activated, usually by heating the fabric and adhesive with hot air. Another suitable bonding method is pattern bonding, wherein heated calendar rolls or ultrasonic bonding equipment are used to bond the fibers together, usually in a localized bond pattern, though the fabric can be bonded across its entire surface if so desired. Another suitable and well-known bonding method, particularly when using bi-component staple fibers, is through-air bonding.

(c) "Cross machine direction" ("CD") means the direction or axis of the product or material generally perpendicular to the machine direction.

(d) "Disposable" includes being discarded of after use, and not intended to be washed and reused.

(e) "Fabric" is used to refer to all of the woven, knitted, and nonwoven webs.

(f) "Flexible" refers to materials or fabrics that are compliant and readily conform to the general shape and contours of an individual's body.

(g) "Gatherable" material is one which, when bonded to a web with the latter under tension, will gather, with the formation of puckers or gathers, to accommodate contraction of the web upon release of the tensioning forces.

(h) "Hydrophilic" describes fibers or surfaces of fibers that are wetted by the aqueous liquids in contact with the fibers. The degree of wetting of the materials can be described in terms of contact angles and the surface tensions of the liquids and materials involved. Equipment and techniques suitable for measuring the wettability of particular fiber materials or blends of fiber materials can be provided by a Cahn SFA-222 Surface Force Analyzer System. When measured with this system, fibers having contact angles less than 90° are designated "wettable", i.e., "hydrophilic", and fibers having contact angles greater than 90° are "nonwettable", i.e., "hydrophobic".

(i) "Joining", "join", "joined", or variations thereof, when used in describing the relationship between two or more elements, means that the elements can be connected together in any suitable manner, such as by heat sealing, ultrasonic bonding, thermal bonding, adhesives, stitching, or the like. Further, the elements can be joined directly together, or may have one or more elements interposed between them, all of which are connected together. The elements can be permanently or refastenably joined together.

(j) "Machine direction" ("MD") means the direction in which the product or material is produced or the axis of the fabric corresponding to the direction of the machine operations.

(k) "Meltblown fibers" means fibers formed by extruding a molten thermoplastic material through a plurality of fine, usually circular, die capillaries as molten threads or filaments into converging high velocity, usually hot gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example in U.S. Pat. No. 3,849,241 issued to Butin et al. which is incorporated herein by reference. Meltblown fibers are microfibers which may be continuous or discontinuous, are generally smaller than 10 microns in average diameter, and are generally tacky when deposited onto a collecting surface.

(l) "Multi-layer laminate" means a laminate wherein some of the layers are spunbond and some are meltblown having a configuration such as spunbond/meltblown/spunbond (SMS) laminate and others as disclosed in U.S. Pat. No. 4,041,203 issued to Brock et al.; U.S. Pat. No. 5,169,706 issued to Collier et al.; U.S. Pat. No. 5,145,727 issued to Potts et al.; U.S. Pat. No. 5,178,931 issued to Perkins, et al.; and, U.S. Pat. No. 5,188,885 issued to Timmons et al., all of which are incorporated herein by reference. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 osy to about 12 osy (6 to 400 gsm), or more particularly from about 0.75 osy to about 3 osy. Multi-layer laminates may also have various numbers of meltblown layers or multiple spunbond layers in may different configurations and may include other materials like films or coform materials.

(m) "Nonwoven fabric or web", "nonwoven web", and "nonwoven fabric" mean a web having a structure of individual fibers or threads which are interlaid, but not in an identifiable manner as in a knitted fabric. Nonwoven fabrics or webs have been formed from many processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns.

(n) "Protective cover" means a cover for floor coverings, table cloths, beach towels, and picnic area ground covers.

(o) "Polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

(p) "Spunbonded fibers" refers to small diameter fibers which are formed by extruding molten thermoplastic material as filaments from a plurality of fine, usually circular capillaries or spinneret with the diameter of the extruded filaments then being rapidly reduced as methods discussed, for example, in U.S. Pat. No. 4,340,563 issued to Appel et al.; U.S. Pat. No. 3,692,618 issued to Dorschner et al.; U.S. Pat. No. 3,802,817 issued to Matsuki et al.; U.S. Pat. Nos. 3,338,992 and 3,341,394 issued to Kinney; U.S. Pat. No. 3,502,763 issued to Hartman; and, U.S. Pat. No. 3,542,615 issued to Dobo et al., all of which are incorporated herein by reference. Spunbond fibers are generally not tacky when they are deposited onto a collecting surface. Spunbond fibers are generally continuous and have average diameters (from a sample of at least 10) larger than about 7 microns, more particularly, between about 10 and about 20 microns.

(q) "Stitchbonded" means, for example, the stitching of a material in accordance with U.S. Pat. No. 4,891,957 issued to Strack et al. or U.S. Pat. No. 4,631,933 issued to Carey, Jr, all of which are incorporated herein by reference.

(r) "Stretch bonded laminate" ("SBL") refers to a composite material having at least two layers in which one layer is a gatherable layer and the other layer is a stretchable, that is, elastic, layer. The layers are joined together when the stretchable layer is in a stretched condition so that upon relaxing the layers, the gatherable layer is gathered.

(s) "Thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen pattern with about a 30% bond area with about 200 bonds/square inch as taught in U.S. Pat. No. 3,855,046 issued to Hansen et al. The Hansen pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As in well known in the art, the spot bonding holds the laminate layers together as well as imparts integrity to each individual layer by bonding filaments and/or fibers within each layer.

(t) "Through air bonding" ("TAB") means a process of bonding a nonwoven bicomponent fiber web in which air which is sufficiently hot to melt one of the polymers of which the fibers of the web are made is forced through the web. The air velocity is between 100 and 500 feet per minute and the dwell time may be as long as 6 seconds. The melting and resolidification of the polymer provides the bonding. Through air bonding has restricted variability and is generally regarded a second step bonding process. Since TAB requires the melting of at least one component to accomplish bonding, it is restricted to webs with two components such as bicomponent fiber webs.

(u) "Ultrasonic bonding" means a process performed, for example, by passing the fabric between a sonic horn and anvil roll as illustrated in U.S. Pat. No. 4,374,888 issued to Bornslaeger.

These definitions are not intended to be limiting and these terms may be defined with additional language in the remaining portion of the specification.

DETAILED DESCRIPTION

The present invention is for a protective cover article 14 to cover the ground or other surface or objects such as a car, furniture, or a grill. The protective cover article 14 includes both washable and disposable type articles. The protective cover article 14 is preferably soft, flexible, and cloth-like. The protective cover articles 14 are also preferably light weight, easy to store, and durable during use. The protective cover articles 14 include, but are not limited to, ground cover blankets, tablecloths, beach towels, changing pads, rugs, mats, and placemats, and the like.

Figure 3:
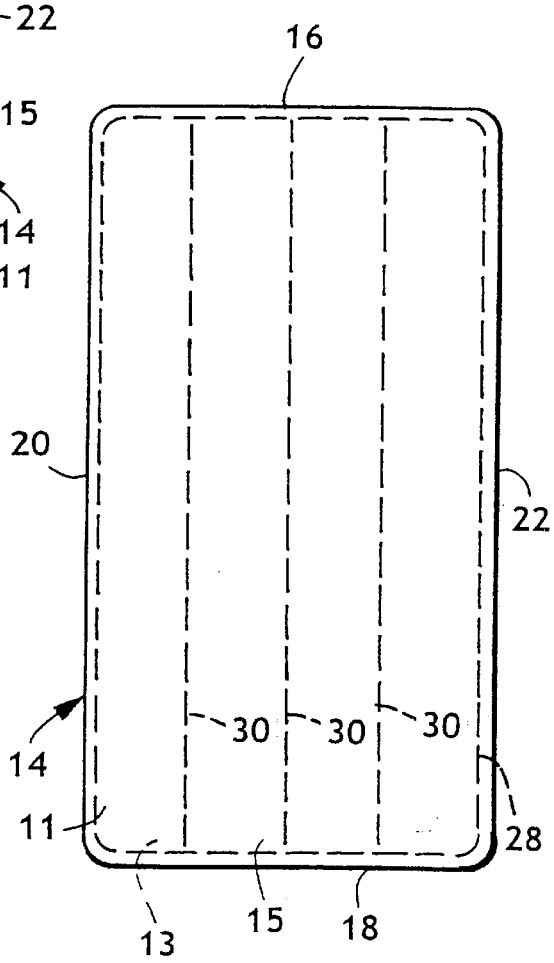
FIG. 3 is a top plan view of a protective cover article.
Figure 6:
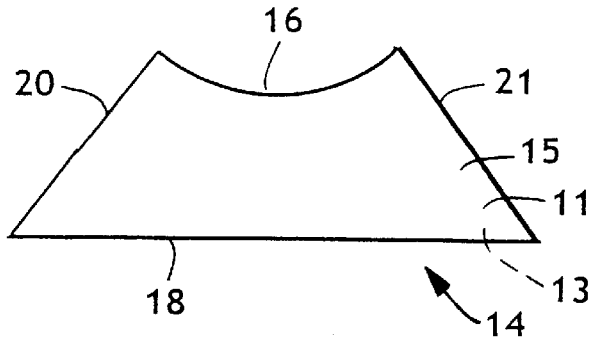
FIG. 6 is a top plan view of a protective cover article.

One embodiment of the present invention is a protective cover article 14 as illustrated in FIGS. 1, 3, and 6, having a top surface 11, a bottom surface 13, and side edges 16, 18, 20, and 22. In some embodiments the top surface 11 comprises a separate layer from the bottom surface 13. In other embodiments, the top surface 11 comprises a separate face of the same layer for which the bottom surface 13 comprises another face. (See FIGS. 8 and 9).

Figure 2:
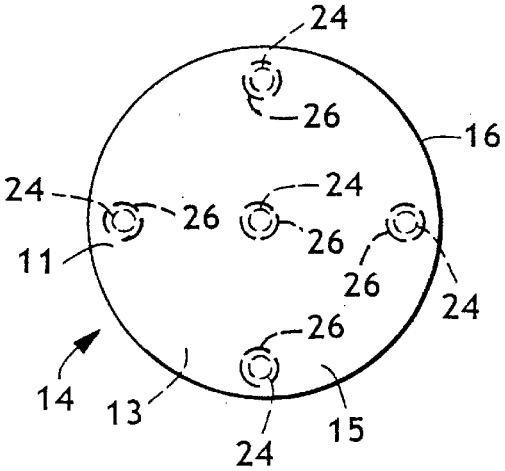
FIG. 2 is a top plan view of a protective cover article.
Figure 4:
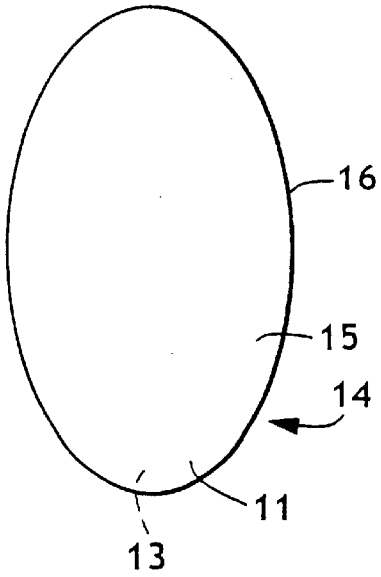
FIG. 4 is a top plan view of a protective cover article.

Another embodiment of the present invention is a protective cover article 14 as illustrated in FIGS. 2 and 4, having a top surface 11, a bottom surface 13, and a side edge 16. In some embodiments the top surface 11 comprises a separate layer from the bottom surface 13. In other embodiments, the top surface 11 comprises a separate face of the same layer for which the bottom surface 13 comprises another face.

Figure 5:
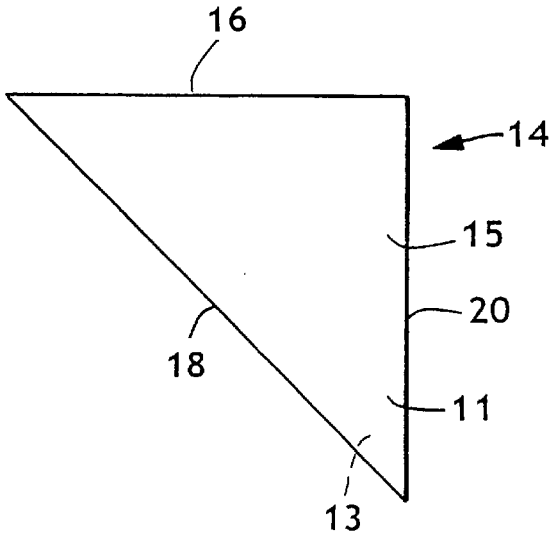
FIG. 5 is a top plan view of a protective cover article.

Another embodiment of the present invention is a protective cover article 14 as illustrated in FIG. 5, having a top surface 11, a bottom surface 13, and side edges 16, 18, and 20. In some embodiments the top surface 11 comprises a separate layer from the bottom surface 13. In other embodiments, the top surface 11 comprises a separate face of the same layer for which the bottom surface 13 comprises another face.

Figure 7:
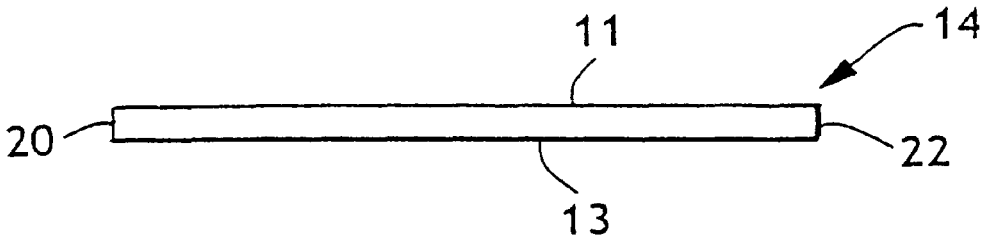
FIG. 7 is a cross sectional view of one embodiment of the protective cover article.
Figure 8:
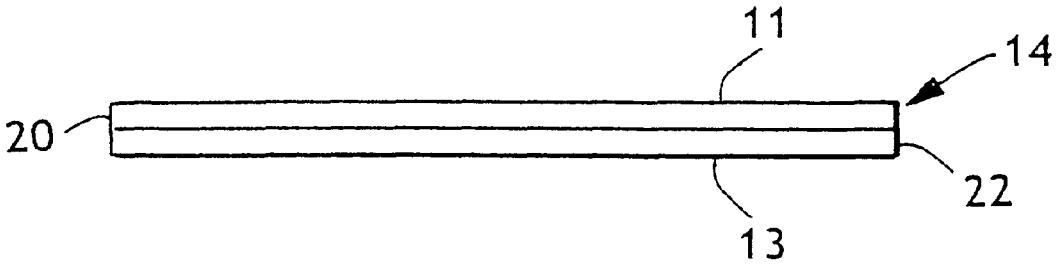
FIG. 8 is a cross sectional view of another embodiment of the protective cover article.

The protective cover article 14 may be of a single layer article or a multi-layer article as shown in FIGS. 7 and 8, respectively. The following description of materials from which the web of fabric 15 may be formed would also be used for the materials to form the top surface 11 and the bottom surface 13 of a multi-layer laminate web of fabric 15.

The web of fabric 15 may be any suitable material, such as a woven material, a nonwoven material, a fibrous or a polymeric film material and may be, although they need not necessarily be, an elastic material or of a stretchable nature. Suitable fibrous webs may utilize any suitable natural and/or synthetic fibers, for example, woven or nonwoven webs of fibers made of acrylic polymers, polyester, polyamide, rayon, glass, polyolefins, e.g., polyethylene and polypropylene, cellulosic derivatives such as cotton, silk, wool, pulp, paper, and the like, as well as blends or combinations of any two or more of the foregoing. The web of fabric 15 may also comprise polymeric film layers such as polyethylene, polypropylene, polyamide, polyester, acrylic polymers, and compatible mixtures, blends, and copolymers thereof.

The web of fabric 15 may be liquid pervious, permitting liquids to readily penetrate into its thickness, or impervious, resistant to the penetration of liquids into its thickness. The web of fabric 15 may also be constructed such that it is breathable, non-breathable, or a combination thereof. The web of fabric 15 may be made from a wide range of materials, such as natural fibers (e.g. wood or cotton fibers), synthetic fibers (e.g. rayon, polyester or polypropylene fibers), or from a combination of natural and synthetic fibers or reticulated foams and apertured plastic films. The web of fabric 15 may be woven, nonwoven, or film such as spunbonded, carded, or the like. A suitable web of fabric 15 may carded, and thermally bonded by means well known to those skilled in the fabric art.

Alternatively, the web of fabric 15 may be derived from a spunbonded web. In a desired embodiment, the web of fabric 15 is spunbonded polypropylene nonwoven, meltblown polypropylene nonwoven, and spunbonded polypropylene nonwoven laminate (SMS). The total basis weight is from about 0.15 osy to about 8.0 osy (more desirably 2.8 osy) and is made with about 86% spunbonded nonwoven and 14% meltblown nonwoven. A pigment such as titanium dioxide may be incorporated into the web of fabric 15. Such a spunbonded meltblown nonwoven laminate material is available from Kimberly-Clark Corporation, Roswell, Ga. The basis weight of the SMS material may vary from about 0.4 osy to about 1.0 osy.

In other desired embodiments, the web of fabric 15 is spunbonded polypropylene nonwoven with a wire-weave bond pattern having a grab tensile of 19 pounds as measured by ASTM D01682 and D01776, a Taber 40 cycle abrasion rating of 10 as measured by ASTM D1175 and Handle-O-Meter MD value of 6.6 grams as measured by the INDA standard test IST 90.0-75(R82) and CD value of 4.4 grams using TAPPI method T402. Such a spunbonded material is available from Kimberly-Clark Corporation. Roswell, Ga. The web of fabric 15 has a weight of from about 0.5 osy to about 2.5 osy, desirably about 1.5 osy.

The web of fabric 15 may be constructed of a single spunbonded polypropylene nonwoven web having a basis weight of about 0.5 osy (17 gsm) to about 1.5 osy (51 gsm). In the structure of the protective cover article 14, the web of fabric 15 desirably comprises a material having a basis weight of from about 0.5 osy (17 gsm) to about 1.5 osy (51 gsm). Lesser or greater basis weights may be used in the other regions of the protective cover article 14, such as the edges 16, 18, 20, and 22, or any other portions of the protective cover article 14. Additionally, the web of fabric 15 or portions thereof, can be made of materials having an abrasion resistant characteristic.

The web of fabric 15 may be any soft and flexible sheet. The web of fabric 15 may permit submersion in fresh water or salt water or treated water (chlorinated or brominated) and still retain its integrity. The web of fabric 15 may comprise, for example, a nonwoven web or sheet of a spunbonded, meltblown, or bonded-carded web composed of synthetic polymer filaments, such as polypropylene, polyethylene, polyesters, or the like, or a web of natural and synthetic fibers or filaments such as cotton and rayon. The web of fabric 15 may be selectively embossed or perforated with discrete slits or holes extending therethrough.

The web of fabric 15 may be further dyed, pigmented, or imprinted with any suitable color. Desirably, the web of fabric 15 is dyed, pigmented, or printed with a material which does not irritate or bleed the color onto the skin of the user. The web of fabric 15 may be naturally hydrophobic or may be treated to make it hydrophobic if so desired.

For embodiments wherein the web of fabric 15 is a multi-layer laminate or structure, both the bottom surface 13 and the top surface 11 are desirably compliant and soft feeling to the user. The bottom surface 13 and the top surface 11, in a multi-layer structure may be bonded together by an method known in the art, including but not limited to, ultrasonic bonding, sewing, stitchedbonding, adhesives, thermal bonding, and heat sealing. The following description of materials from which the bottom surface 13 may be formed may also be used to form the material of the top surface 11.

The bottom surface 13 may be any suitable gatherable material, such as a woven material, a nonwoven material, and a fibrous or a polymeric film material and may be, although they need not necessarily be, an elastic material or of a stretchable nature. Suitable fibrous gatherable webs may utilize any suitable natural and/or synthetic fibers, for example, woven or nonwoven webs of fibers made of acrylic polymers, polyester, polyamide, rayon, glass, polyolefins, e.g., polyethylene and polypropylene, cellulosic derivatives such as cotton, silk, wool, pulp, paper, and the like, as well as blends or combinations of any two or more of the foregoing. The gatherable webs may also comprise polymeric film layers such as polyethylene, polypropylene, polyamide, polyester, acrylic polymers, and compatible mixtures, blends, and copolymers thereof.

The bottom surface 13 may be liquid pervious, permitting liquids to readily penetrate into its thickness, or impervious, resistant to the penetration of liquids into its thickness. The bottom surface 13 may be made from a wide range of materials, such as natural fibers (e.g. wood or cotton fibers), synthetic fibers (e.g. rayon, polyester, or polypropylene fibers), or from a combination of natural and synthetic fibers or reticulated foams and apertured plastic films. The bottom surface 13 may be woven, nonwoven, or film such as spunbonded, carded, or the like. A suitable material for the bottom surface 13 may be carded, and thermally bonded by means well known to those skilled in the fabric art.

Alternatively, the bottom surface 13 may be derived from a spunbonded web. In a desired embodiment, the bottom surface 13 is spunbonded polypropylene nonwoven, meltblown polypropylene nonwoven and spunbonded polypropylene nonwoven laminate (SMS). The total basis weight is from about 0.3 osy to about 4.0 osy (more desirably 1.5 osy) and is made with about 86% spunbonded nonwoven and 14% meltblown nonwoven. A pigment such as titanium dioxide may be incorporated into the bottom surface 13 and the top surface 11. Such spunbonded meltblown nonwoven laminate material is available from Kimberly-Clark Corporation, Roswell, Ga. The basis weight of the SMS material may vary from about 0.4 osy to about 1.0 osy.

In other desired embodiments, the bottom surface 13 is spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams as measured by the INDA standard test IST 90.0-75(R82) and CD value of 4.4 grams using TAPPI method T402. Such spunbonded material is available from Kimberly-Clark Corporation, Roswell, Ga. The bottom surface 13 has a weight of from about 0.5 osy to about 2.5 osy, desirably about 1.5 osy.

The bottom surface 13 may be constructed of a single spunbonded polypropylene nonwoven web having a basis weight of about 0.5 osy (17 gsm) to about 1.5 osy (51 gsm). In the structure of the protective cover article 14, the bottom surface 13 desirably comprises a material having a basis weight of from about 0.5 osy (17 gsm) to about 1.5 osy (51 gsm). Lesser or greater basis weights may be used in the other regions of the protective cover article 14, as discussed above, in the bottom surface 13. Additionally, the bottom surface 13 or portions thereof, can be made of materials having an abrasion resistant characteristic.

The top surface 11 may be any soft and flexible sheet. The top surface 11 may permit submersion in fresh water or salt water or treated water (chlorinated or brominated) and still retain its integrity. The top surface 11 may comprise, for example, a nonwoven web or sheet of a spunbonded, meltblown, or bonded-carded web composed of synthetic polymer filaments, such as polypropylene, polyethylene, polyesters, or the like, or a web of natural and synthetic fibers or filaments such as cotton and rayon. The top surface 11 may be selectively embossed or perforated with discrete slits or holes extending therethrough. Suitable adhesives for adhering the laminate layers can be obtained from Findley Adhesives, Inc. of Wauwatosa, Wis.

The top surface 11 may be constructed of a single spunbonded polypropylene nonwoven web having a basis weight of about 0.5 osy (17 gsm) to about 1.5 osy (51 gsm). In the structure of the protective cover article 14, the top surface 11 desirably comprises a material having a basis weight of from about 0.5 osy (17 gsm) to about 1.5 osy (51 gsm). Lesser or greater basis weights may be used in the other regions of the protective cover article 14, as discussed above, in the top surface 11. Additionally, the top surface 11 or portions thereof, can be made of materials having an abrasion resistant characteristic.

The bottom surface 13 and the top surface 11 may be further dyed, pigmented, or imprinted with any suitable color. The bottom surface 13 and the top surface 11 may be identical or different. Desirably, the bottom surface 11 is either dyed, pigmented, or printed with a material which does not irritate or bleed the color onto the skin of the user.

Additionally, the web of fabric 15 may comprise monocomponent or bicomponent spunbond fibers. Generally, methods for making spunbond fiber nonwoven or woven webs of fabric 15 include extruding molten thermoplasic polymer through a spinneret, quenching the filaments, and then drawing the quenched filaments with a stream of high velocity air to form a web of randomly arrayed fibers on a collecting surface or other method of handling to form a woven web of fabric 15. As examples, methods for making the nonwoven webs of fabric 15 are described in U.S. Pat. No. 4,692,618 issued to Dorschner et al.; U.S. Pat. No. 4,340,563 issued to Appel et al.; and, U.S. Pat. No. 3,802, 817 issued to Matsuki et al., all of which are incorporated herein by reference.

Monocomponent fibers may be formed from one or more extruders using only one polymer. This is not meant to exclude fibers formed from one polymer to which small amounts of additives have been added for coloration, antistatic properties, lubrication, hydrophilicity, etc. These additives, e.g. titanium dioxide for coloration, are generally present in an amount less than 5 weight percent and more typically about 2 weight percent.

Bicomponent fibers, also referred to as biconsitutuent, conjugate, or multiconstituent fibers, are discussed in, for example, U.S. Pat. No. 5,108,827 issued to Gessner; U.S. Pat. No. 5,108,820 issued to Kaneko et al.; U.S. Pat. No. 5,336,552 issued to Strack et al.; and, U.S. Pat. No. 5,382, 400 issued to Pike et al., all of which are incorporated herein by reference. For two component fibers, the polymers may be present in ratios of 75/25, 50/50, 25/75 or any other desired ratios. Such fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

Such multicomponent spunbond fibers may be formed from at least two polymer streams but spun together to form a unitary fiber. The individual components comprising the multicomponent fiber are usually different polymers and are arranged in distinct zones or regions that extend continuously along the length of the fibers. The configuration of such fibers can vary and commonly the individual components of the fiber can be positioned in a side-by-side arrangement, sheath/core arrangement, pie or wedge arrangement, islands-in-sea arrangement and so forth. Multicomponent fibers and methods of making the same are known in the art, an by way of example only, are described in U.S. Pat. No. 5,382,400 issued to Pike et al.; U.S. Pat. No. 5,534,339 issued to Stokes et al.; and, U.S. Pat. No. 5,989, 004 issued to Cook, all of which are incorporated herein by reference.

The web of fiber 15 may also comprise hollow fibers as discussed in U.S. patent application filed on Jan. 27, 1999 for Detamore et al. and having the Ser. No. 09/117,382, and U.S. Pat. No. 3,772,137 issued to Tolliver, all of which are incorporated herein by reference.

The protective cover article 14 may take any shape. The shape of the protective cover article 14 may include square, rectangular, triangular, circular, oblong, regular or symmetrically shaped, or irregular or asymmetrically shaped as well as three dimensional shapes. (See FIGS. 1–6).

The side dimensions of the protective cover article 14 may be less than one about foot, about one (1) foot, about two (2) feet, about three (3) feet, about four (4) feet, about five (5) feet, about six (6) feet, about seven (7) feet, about eight (8) feet, about nine (9) feet, about ten (10) feet, about eleven (11) feet, about twelve (12) feet, about thirteen (13) feet, about fourteen (14) feet, about fifteen (15) feet, about sixteen (16) feet, about seventeen (17) feet, about eighteen (18) feet, about nineteen (19) feet, about twenty (20) feet, or greater. It is also understood that the dimensions of the sides may vary within a given protective cover article 14. Also, it is understood that the dimensions may be portions of the foot intervals as discussed above as well (for example: one (1) foot by two (2) feet, six (6) inches; one (1) foot, four (4) inches by two (2) feet, six (6) inches; four (4) feet, eight (8) inches by four (4) feet, eight (8) inches; six (6) feet, five (5) inches by four (4) feet, nine (9) inches; or, five (5) feet, seven (7) inches by seven (7) feet, five (5) inches). The protective cover articles 14 may be made from a single sheet of the web of fabric 15 or pieces or strips of the web of fabric 15 to form the protective cover articles 14.

The protective cover article 14 desirably has a basis weight sufficient provide the protection or comfort for which the protective cover article 14 is being employed. For example, the basis weight of the fabric 15 should be sufficient to provide a more comfortable surface to sit or recline on at a beach or park than sitting directly on the ground or on other conventional articles such as a typical beach towel.

It is also desirable that the protective cover article 14 be permeable to air while being hydrophobic. Many of the conventional articles that provide hydrophobic characteristics do so at the expense of permeability. For example, rubber backed woven blankets that can be used at the beach are not comfortable for use as a blanket over the user because of the rubber portion of the blanket. In addition, such rubber backed woven blankets can become water- and sand-logged in the woven portion of the blanket making use and handling of the blanket very difficult and messy.

The protective cover article 14 may also be resistant to abrasion. This is important, not only for appearance characteristics, but for the protective characteristics of the protective cover article 14. For example, conventional woven blankets show wear due to abrasion encounter during normal use, such as at a beach. Those worn areas are more likely to result in sand or other foreign materials coming in contact with the user or otherwise providing a less comfortable use. It is also a desirable feature of the protective cover article 14 to be colorfast during exposure to sunlight.

It is also desirable for the protective cover article 14 to be resistant to pilling and fuzzing for appearance as well as comfort during use. Conventional woven blankets typically used at the beach are susceptible to pilling and fuzzing. The pilling and fuzzing can create pills on the surface of such blankets which are at the least uncomfortable to sit or recline upon.

Due to the various uses that a protective cover article 14 may be employed, it is reasonable to expect the protective cover article 14 would be laundered. It is desirable that the protective cover article 14 be constructed of a fabric 15 that would maintain its dimensions and shape. Many of the conventional blankets, or the like, used to provide protection or cover shrink or otherwise experience dimensional changes. This may result in not only appearance issues of such a blanket, but may also pose use problems due to the changes in the dimensions of the blanket.

The protective cover article 14 should be able to resist many of the stains that one would expect the protective cover article 14 to be exposed during use. In addition, resistance of the protective cover article 14 to retaining sand, soil, and other foreign materials as well as water provides better appearance, protection, handling, and storage characteristics.

The protective cover article 14 may also include weights or weighted material devices 24 known in the art, including, but not limited to, metallic or non-metallic objects, stone objects, sand, liquid-filled objects, plastic objects, and the like. (See FIGS. 1 and 2) The weights or weighted material devices 24 may be used to aid in maintaining the position of the protective cover article 14. The weights or weighted material devices 24 may take any shape known in the art and as desired for use in the protective cover article 14. The placement and the number of weights or weighted material devices 24 used in a protective cover article 14 may vary depending upon intended use of the protective cover article 14, the size of the protective cover article 14, and the desired appearance of the protective cover article 14.

The weights 24 may be placed adjacent one or more edges 16, 18, 20, and 22 as shown in FIG. 1. In another embodiment, the weights 24 may be placed in regions or areas of the protective cover article 14 that are not adjacent one or more edges 16, 18, 20, and 22 as shown in FIG. 2. Alternatively, the weights 24 may be placed such that weights 24 are placed adjacent one or more edges 16, 18, 20, and 22 as well as in regions or areas of the protective cover article 14 that are not adjacent one or more edges 16, 18, 20, and 22.

The weights 24 may be joined to the top surface 11, the bottom surface 13, or to both the top and bottom surfaces 11 and 13 of the protective cover article 14. Additionally, weights 24 may also be placed between the layers of a multi-layer protective cover article 14. The weights 24 may be joined by any means known in the art, including but not limited to adhesives, stitching, thermal bonding, heat sealing, ultrasonic bonding, or the like. The weights 24 may be refastenably or permanently joined to the protective cover article 14.

In some embodiments, the weights 24 may be joined directly to the protective cover article 14. In other embodiments, it may be desirable for the weights 24 be encased in a fabric cover 26 prior to joining to the protective cover article 14 as shown in FIG. 2. The fabric cover 26, containing the weight 24, may be joined to the protective cover article 14 by any means known in the art, including but not limited to adhesives, stitching, thermal bonding, heat sealing, ultrasonic bonding, or the like. The fabric covers 26, containing the weights 24, may be refastenably or permanently joined to the protective cover article 14.

In some embodiments of a multi-layer protective cover article, it may be desirable to join the layers together adjacent the edge 16, 18, 20, or 22 as represented by the element number 28 shown in FIG. 3. In addition, it may be desirable to join the layers together in at least one region not adjacent an edge 16, 18, 20, or 22 as represented by the element number 30 also shown in FIG. 3 depicting three regions of joining. The regions or points of joining represented by element number 30 may be in straight lines (as shown in FIG. 3), repeating patterns, or any other pattern, including irregular or non-repeating patterns. The regions or points of joining 30 may be less than about one (1) inch apart, or may range from about one (1) inch to about thirty six inches apart, from about two (2) inches to about thirty (30) inches apart, from about four (4) inches to about twenty four (24) inches apart, from about six (6) inches to about eighteen (18) inches apart, from about eight (8) inches to about twelve (12) inches apart.

Test Methods

Test Method 1: Basis Weight

The basis weight of fabric is measured using the ASTM D 3776-96. The testing is performed in standard atmospheric conditions (70+/−2° C., 65+/−2% R.H.) using a Mettler Balance (Model B-6) as the testing apparatus. The average basis weight is reported in osy and gsm.

It is desirable that the basis weight of the fabric of the protective cover article range between from about 0.15 osy to about 8.0 osy, from about 0.5 osy to about 6.0 osy, from about 0.75 osy to about 5.0 osy, from about 1.0 osy to about 2.2 osy, or about 1.5 osy.

Test Method 2: Air Permeability

The air permeability of fabric is measured using the ASTM D 737-96. The testing is performed in a conditioned atmosphere in accordance with standard test method procedures (conditions (70+/−2° C., 65+/−2% R.H.) using a High Pressure Differential Air Permeability Machine from Frazier Precision Instrument Co. as the testing apparatus. The average air flow through fabric is reported in $ft^3/min/ft^2$.

It is desirable that the air permeability of the fabric of the protective cover article range between from about 60 $ft^3/min/ft^2$ to about 110 $ft^3/min/ft^2$, from about 70 $ft^3/min/ft^2$ to about 100 $ft^3/min/ft^2$, from about 80 $ft^3/min/ft^2$ to about 95 $ft^3/min/ft^2$, or from about 85 $ft^3/min/ft^2$ to about 90 $ft^3/min/ft^2$.

Test Method 3: Abrasion Resistance—Flex

The abrasion resistance of fabric is measured using the ASTM D 3885-99 in the warp direction of the material/fabric and the ASTM D 3885-99 in the filling direction of the material/fabric. The testing is performed in a conditioned atmosphere in accordance with standard test method procedures (conditions (70+/−2° C., 65+/−2% R.H.) using a CSI Stoll QM Universal Wear Tester (Model # CS-22C) with a Flex Abrasion Attachment as the testing apparatus. The apparatus is set at a tension load of 2 lbs. and a balance head load of 0.5 lbs. The average flex resistances in the warp (MD) and filling (CD) directions are reported in the number of cycles required to reach failure.

It is desirable that the abrasion resistance flex of the fabric of the protective cover article in the warp direction range between from about 100 cycles to about 300 cycles, from about 150 cycles to about 250 cycles, or about 200 cycles.

It is desirable that the abrasion resistance flex of the fabric of the protective cover article in the filling direction range between from about 40 cycles to about 140 cycles, from about 60 cycles to about 130 cycles, from about 80 cycles to about 110, or about 95 cycles.

Test Method 4: Colorfastness to Light

The colorfastness to light of fabric is measured by exposing the fabric to 40 AATCC fading units of outdoor light and tested for light colorfastness according to the AATCC test method 16-1998. An Atlas C165A Xenon Weather-O-meter (model # C1-65A), set per the test conditions listed in Option E of the AATCC 16-1998 test method, is used as the testing apparatus. Two separate evaluators make visual evaluations of the color change of three specimens of each test fabric. The average colorfastness is reported on a 1–5 scale with 5 representing no color change after exposure to light and 1 representing heavily changed color change when compared to the Gray Scale For Color Change under AATCC Evaluation Procedure 1. The colorfastness to light of the fabric may be also evaluated instrumentally using a HunterLab (LabScan2 0/45) spectrophotometer.

It is desirable that the colorfastness to light of the fabric of the protective cover article range between from about 5 to about 4.5, from about 5 to about 4.75, or about 5.

Test Method 5: Pilling Resistance—Random Tumble Method—Fuzz

The pilling resistance of fabric is tested before laundering according to the ASTM D 3512-99. The test fabric is tested after laundering five times as set forth in the ASTM D 3512-99. Each laundering is performed in a conventional washing machine and dryer at the following settings: Machine Wash, Warm Water Temp, Normal Agitation, and Low Tumble Dry (below 190° F.) using standard AATCC laundry detergent. Testing is performed under standard atmospheric conditions (70+/−2° C., 65+/−2% R.H.) using an Atlas Random Tumble Pilling Tester (Model PT-4) as the testing apparatus. The test chamber air pressure injection is set at 2 psi. Two separate evaluators make visual evaluations of the fuzzing resistance of the fabric both before and after laundering five times. The average fuzzing resistance before and after five launderings is reported on a 1–5 scale with 5 representing no pilling or fuzz and 1 representing very severe pilling or fuzz.

It is desirable that the pilling resistance of the unlaundered fabric of the protective cover article range between from about 5 to about 3, from about 4.5 to about 3.5, or about 4.0. It is desirable that the pilling resistance of the laundered fabric of the protective cover article range between from about 5 to about 3, from about 4.5 to about 3.5, or about 4.0.

It is desirable that the fuzzing resistance of the unlaundered fabric of the protective cover article range between from about 5 to about 3, from about 4.5 to about 3.5, or about 4.0. It is desirable that the fuzzing resistance of the laundered fabric of the protective cover article range between from about 5 to about 3, from about 4.5 to about 3.5, or about 4.0.

Test Method 6: Dimensional Change in Home Laundering

The dimensional change during home laundering of fabric is tested after one laundering and after five launderings according to the AATCC 135-1995 in the warp direction of the fabric. The fabric is tested after one laundering and after five launderings as set forth in the AATCC 135-1995 in the filling direction of the fabric/material. Each laundering is performed in a conventional washing machine and dryer at the following settings: Machine Wash, Warm Water Temp, Normal Agitation, and Low Tumble Dry (below 190° F.) using a standard AATCC laundry detergent. The fabric evaluation is performed in standard atmospheric conditions (70+/−2° C., 65+/−2% R.H.) The average percent change in dimensions of the fabric is measured after one laundering and after five launderings.

It is desirable that the dimensional change after one home laundering abrasion of the fabric of the protective cover article in the warp direction range between from about 2.0% to about 3.0%, from about 2.25% to about 2.75%, or about 2.5%. It is desirable that the dimensional change after five home laundering abrasion of the fabric of the protective cover article in the warp direction range between from about 3.5% to about 4.5%, from about 3.75% to about 4.25%, or about 4.0%.

It is desirable that the dimensional change after one home laundering abrasion of the fabric of the protective cover article in the filling direction range between from about 1.5% to about 3.0%, from about 2.0% to about 2.75%, or from about 2.25% to about 2.5%. It is desirable that the dimensional change after five home laundering abrasion of the fabric of the protective cover article in the filling direction range between from about 3.0% to about 4.0%, from about 3.25% to about 3.75%, or about 3.5%.

Test Method 7: Stain Resistance

The stain resistance of fabric to the following stains is determined using the following materials:

Tea: Luzianne Tea, Reily Foods Company, New Orleans, La. 70130

Blueberry: Best Yet Frozen Blueberries, Fleming Companies, Inc, Oklahoma City, Okla. 73126

Beef Blood: Obtained from butcher

Wine: Sutter Home Cabernet Sauvignon wine

Instant Coffee: HyVee Instant Coffee, HyVee, Inc., 5820 Westown Parkway, West Des Moines, Iowa 50265

Mustard: Classic Yellow French's Mustard, Rickett & Colman Inc., Montvale, N.J. 07645

Gravy: Best Yet Homestyle Brown Gravy Mix, Fleming Companies, Inc., Oklahoma City, Okla. 73126

Chocolate Syrup: Critic's Choice Chocolate Flavored Syrup, Amway Corp., Ada, Mich. 49355-0001

Grape Juice: Juicy Juice Grape Juice, Nestle USA, Beverage Division, Inc., Glendale, Calif. 91203.

Clay: Claystone Grey Self-hardening Modeling Clay, Standard Clay Mines, 100 Camp Meeting Avenue, Skillman, N.J. 08558

Ketchup: Extra Thick Critic's Choice Tomato Ketchup, Amway Corp., Ada, Mich. 49355-0001

The fabrics are exposed to the above materials and laundered five times according per ASTM D 4265-98. Each laundering is performed in a conventional washing machine and dryer at the following settings: Machine Wash, Warm Water Temp, Normal Agitation, and Low Tumble Dry (below 190° F.) using a standard AATCC laundry detergent. Two separate evaluators (ASTM D 4265-98 stipulates three evaluators) make visual evaluations of the stain resistance of the fabric to the above materials. The average stain resistance of the fabric to each material is reported on a 1-5 scale with 5 representing no residue stain after five launderings and 1 representing residual stain equivalent to Replica 1 when compared to AATCC Stain Release Replica available from AATCC, Research Triangle Park, N.C.

It is desirable that the stain resistance to tea of the laundered fabric of the protective cover article range between from about 4 to about 5, from about 4.5 to about 5, or is 5.

It is desirable that the stain resistance to blueberry of the laundered fabric of the protective cover article range between from about 4 to about 5, from about 4.5 to about 5, or is 5.

It is desirable that the stain resistance to beef blood of the laundered fabric of the protective cover article range between from about 4 to about 5, from about 4.5 to about 5, or is 5.

It is desirable that the stain resistance to wine of the laundered fabric of the protective cover article range between from about 4 to about 5, from about 4.5 to about 5, or is 5.

It is desirable that the stain resistance to instant coffee of the laundered fabric of the protective cover article range between from about 4 to about 5, from about 4.5 to about 5, or is 5.

It is desirable that the stain resistance to mustard of the laundered fabric of the protective cover article range between from about 4 to about 5, from about 4.5 to about 5, or is 5.

It is desirable that the stain resistance to gravy of the laundered fabric of the protective cover article range between from about 4 to about 5, from about 4.5 to about 5, or is 5.

It is desirable that the stain resistance to chocolate syrup of the laundered fabric of the protective cover article range between from about 4 to about 5, from about 4.5 to about 5, or is 5.

It is desirable that the stain resistance to grape juice of the laundered fabric of the protective cover article range between from about 4 to about 5, from about 4.5 to about 5, or is 5.

It is desirable that the stain resistance to clay of the laundered fabric of the protective cover article range between from about 4 to about 5, from about 4.5 to about 5, or is 5.

It is desirable that the stain resistance to ketchup of the laundered fabric of the protective cover article range between from about 4 to about 5, from about 4.5 to about 5, or is 5.

Test Method 8: Colorfastness to Laundering

The colorfastness to laundering is measured per AATCC test method 61-1996. An Atlas Launder-O-meter (model # LEF) is used to accelerate laundering the test fabrics. The conditions of testing are set per test number 2A in AATCC test method 61-1996: 49° C. (120° F.); 150 mL liquor volume; 0.15% detergent solution; 50 steel balls; time period of 45 minutes; one pass through wringer; and, tumble dry (below 190° F.). The conditions simulates five home machine launderings at medium or warm setting in the temperature range of 38+/−3° C. (100+/−5° F.). Two separate evaluators make visual evaluations of the color change of the test fabric. The colorfastness to light of the fabric may be also evaluated instrumentally using a HunterLab (LabScan2 0/45) spectrophotometer. The average colorfastness of the test fabric is reported on a 1–5 scale with 5 representing no color change after laundering and 1 representing heavily changed color change when compared to the Gray Scale For Color Change under AATCC Evaluation Procedure 1.

It is desirable that the colorfastness to light of the fabric of the protective cover article range between from about 5 to about 4.5; from about 5 to about 4.75, or about 5.

Test Method 9: Hydrostatic Water Resistance

The hydrostatic water resistance is the resistance to the penetration of water under low hydrostatic pressure of fabric. The two layers of nonwoven material are layered together so that the formation sides of each layer were touching each other (non-formation sides out). The two layers of test fabric are not stitched together. An Expulsion Press Die-Cutter with dies (TMI DGD, part number 22-16-00) from Testing Machines, Inc. is used to cut six (6) inch diameter circular test fabric pieces.

Each six inch diameter pieces of the test fabric are mounted on a TEXTES FX-3000 hydrostatic head tester (part number FX-3000) form clamped down on the test head reservoir. The test fabric pieces are placed over the test head and clamped down so that a proper seal is formed with the test head around the entire edge of the test fabric pieces. The large, 100 $cm^2$ test head, filled to the rim with purified water at 75 +/−10° F., is used for this test method. The test fabric piece is then subjected to a standardized water pressure, which was increased at a constant rate. The resistance of the test fabric to the water pressure is measured in millibars as the hydrostatic head height reaches the first sign of leakage in three separate areas on the test specimen. A higher millibar value indicates greater resistance to water penetration. The hydrostatic water resistance is measured at hydrostatic head height in millibars.

It is desirable that the hydrostatic water resistance of the fabric of the protective cover article range between from about 45.0 to about 55.0 millibars; from about 48.0 to about 54.0 millibars; from about 49.0 to about 53.0 millibars; from about 50.0 to about 52.0 millibars; or about 51.5 millibars.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

We claim:

1. A nonwoven fabric protective cover article comprising:

a. a top surface;

b. a bottom surface;

c. at least one edge; and, d. at least one weight joined thereto, wherein the nonwoven fabric is hydrophobic and has a basis weight from between about 0.15 osy to about 8.0 osy, an air permeability from about 60 $ft^3/min/ft^2$ to about 110 $ft^3/min/ft^2$, and stain resistance from about 4 to about 5 for blueberry, instant coffee, gravy, and wine.

2. The nonwoven fabric protective cover article of claim 1 wherein at least one weight is joined adjacent the edge of the protective cover article.

3. The nonwoven fabric protective cover article of claim 1 wherein at least one weight is joined in at least one region of the protective cover article not adjacent the edge of the protective cover article.

4. The nonwoven fabric protective cover article of claim 1 wherein at least one weight is joined to the top surface of the protective cover article.

5. The nonwoven fabric protective cover article of claim 1 wherein at least one weight is joined to the bottom surface of the protective cover article.

6. The nonwoven fabric protective cover article of claim 1 wherein at least one weight is encased in a fabric cover prior to joining to the protective cover article.

7. The nonwoven fabric protective cover article of claim 1 wherein all weights are encased in fabric cover prior to joining to the protective cover article.

8. The nonwoven fabric protective cover article of claim 1 wherein at least one weight is permanently joined to the protective cover article.

9. The nonwoven fabric protective cover article of claim 1 wherein all weights are permanently joined to the protective cover article.

10. The nonwoven fabric protective cover article of claim 1 wherein the nonwoven fabric has a stain resistance from about 4 to about 5 for tea, clay, ketchup, beef blood, mustard, chocolate syrup, and grape juice.

11. The nonwoven fabric protective cover article of claim 1 wherein the nonwoven fabric has a colorfastness to light from about 4.5 to about 5.

12. The nonwoven fabric protective cover article of claim 1 wherein the nonwoven fabric has a pilling resistance before laundering from about 3 to about 5 and a pilling resistance after laundering from about 3 to about 5.

13. The nonwoven fabric protective cover article of claim 1 wherein the nonwoven fabric has dimensional change after one laundering of about 3.0 percent or less and a dimensional change after five launderings of about 4.5 percent or less.

14. The nonwoven fabric protective cover article of claim 1 and further comprising a warp direction and a filling direction wherein the nonwoven fabric has an abrasion resistance flex in the warp direction from about 100 cycles to about 300 cycles and an abrasion resistance flex in the filling direction from about 40 cycles to 140 cycles.

15. The nonwoven fabric protective cover article of claim 1 wherein the nonwoven fabric has a colorfastness to laundering from about 4.5 to about 5.

16. The nonwoven fabric protective cover article of claim 1 wherein the nonwoven fabric has a hydrostatic water resistance from about 45.0 millibars to about 55.0 millibars.

17. The nonwoven fabric protective cover article of claim 1 further comprising more than one layer of fabric.

18. The nonwoven fabric protective cover article of claim 17 wherein at least one of the weights is joined to the protective cover article between the layers of fabric.

19. The nonwoven fabric protective cover article of claim 18 wherein at least one weight is encased in fabric cover prior to joining to the protective cover article.

20. The nonwoven fabric protective cover article of claim 18 wherein all weights are encased in fabric cover prior to joining to the protective cover article.

21. The nonwoven fabric protective cover article of claim 18 wherein at least one weight is permanently joined to the protective cover article.

22. The nonwoven fabric protective cover article of claim 18 wherein all weights are permanently joined to the protective cover article.

23. The nonwoven fabric protective cover article of claim 17 wherein at least one of the layers of protective cover article is nonwoven material.

24. The nonwoven fabric protective cover article of claim 23 wherein the layers of the protective cover article are not of the same material.

25. The nonwoven fabric protective cover article of claim 17 wherein the layers of the protective cover article are joined together adjacent the edge of the protective cover article.

26. The nonwoven fabric protective cover article of claim 17 wherein the layers of the protective cover articles are joined together adjacent the edge of the protective cover article and in at least one region not adjacent the edge of the protective cover article.

27. The nonwoven fabric protective cover article of claim 26 wherein the regions where the layers of the protective cover article are joined together not adjacent the edge of the protective cover article are at least 2 inches apart.

28. The nonwoven fabric protective cover article of claim 27 wherein the layers of the protective cover article are joined together by stitching.

29. A nonwoven fabric protective cover article comprising:

a. a top surface;

b. a bottom surface;

c. at least one edge;

d. at least two layers; and, e. a plurality of weights joined thereto, wherein the nonwoven fabric is hydrophobic and has a basis weight from between about 0.15 cay to about 8.0 osy, an air permeability from about 60 $ft^3/min/ft^2$ to about 110 $ft^3/ft^2$, and stain resistance from about 4 to about 5 for blueberry, instant coffee, gravy, and wine.

30. The nonwoven fabric protective cover article of claim 29 wherein at least one weight is joined adjacent the edge of the protective cover article.

31. The nonwoven fabric protective cover article of claim 29 wherein at least one weight is joined in at least one region of the protective cover article not adjacent the edge of the protective cover article.

32. The nonwoven fabric protective cover article of claim 29 wherein at least one weight is joined to the top surface of the protective cover article.

33. The nonwoven fabric protective cover article of claim 29 wherein at least one weight is joined to the bottom surface of the protective cover article.

34. The nonwoven fabric protective cover article of claim 29 wherein at least one weight is encased in fabric cover prior to joining to the protective cover article.

35. The nonwoven fabric protective cover article of claim 29 wherein at least one weight is permanently joined to the protective cover article.

36. The nonwoven fabric protective cover article of claim 29 wherein the nonwoven fabric has a stain resistance from about 4 to about 5 for tea, clay, ketchup, beef blood, mustard, chocolate syrup, and grape juice.

37. The nonwoven fabric protective cover article of claim 29 wherein the nonwoven fabric has a colorfastness to light from about 4.5 to about 5.

38. The nonwoven fabric protective cover article of claim 29 wherein the nonwoven fabric has a pilling resistance before laundering from about 3 to about 5 and a pilling resistance after laundering from about 3 to about 5.

39. The nonwoven fabric protective cover article of claim 29 wherein the nonwoven fabric has dimensional change after one laundering of about 3.0 percent or less and a dimensional change after five launderings of about 4.5 percent or less.

40. The nonwoven fabric protective cover article of claim 29 and further comprising a warp direction and a filling direction wherein the nonwoven fabric has an abrasion resistance flex in the warp direction from about 100 cycles to about 300 cycles and an abrasion resistance flex in the filling direction from about 40 cycles to 140 cycles.

41. The nonwoven fabric protective cover article of claim 29 wherein the nonwoven fabric has a colorfastness to laundering from about 4.5 to about 5.

42. The nonwoven fabric protective cover article of claim 29 wherein the nonwoven fabric has a hydrostatic water resistance from about 45.0 millibars to about 55.0 millibars.

43. The nonwoven fabric protective cover article of claim 29 wherein at least one of the weights is joined to the protective cover article between the layers of fabric.

44. The nonwoven fabric protective cover article of claim 29 wherein at least one of the layers of protective cover article is nonwoven material.

45. The nonwoven fabric protective cover article of claim 29 wherein the layers of the protective cover article are not of the same material.

46. The nonwoven fabric protective cover article of claim 29 wherein the layers of the protective cover article are joined together adjacent the edge of the protective cover article.

47. The nonwoven fabric protective cover article of claim 29 wherein the layers of the protective cover articles are joined together adjacent the edge of the protective cover article and in at least one region not adjacent the edge of the protective cover article.

48. The nonwoven fabric protective cover article of claim 47 wherein the regions where the layers of the protective cover article are joined together not adjacent the edge of the protective cover article are at least 2 inches apart.

49. The nonwoven fabric protective cover article of claim 48 wherein the layers of the protective cover article are joined together by stitching.

* * * * *